United States Patent [19]

Ota et al.

[11] Patent Number: 5,056,416

[45] Date of Patent: Oct. 15, 1991

[54] VARIABLE CAPACITY WOBBLE PLATE COMPRESSOR WITH ABRASION AVOIDABLE MOUNTING STRUCTURE FOR WOBBLE PLATE PRESSING SPRING

[75] Inventors: Masaki Ota; Tohru Takeichi; Takahiro Hamaoka, all of Kariya, Japan

[73] Assignee: Kabushiki Kaisha Toyoda Jidoshokki Seisakusho, Kariya, Japan

[21] Appl. No.: 580,216

[22] Filed: Sep. 10, 1990

[30] Foreign Application Priority Data

Sep. 16, 1989 [JP] Japan ..... 1-108531[U]

[51] Int. Cl.[5] ..... F01B 3/00; F01B 13/04

[52] U.S. Cl. ..... 92/12.2; 92/71; 417/222 R; 74/60; 91/499; 91/505

[58] Field of Search ..... 92/12.2, 71; 417/222, 417/262, 222 S; 74/60; 91/499, 505, 506

[56] References Cited

U.S. PATENT DOCUMENTS

| | | | |
|---|---|---|---|
| 1,840,869 | 9/1932 | Rayburn | 92/12.2 |
| 2,344,565 | 3/1944 | Scott et al. | 92/12.2 |
| 2,393,544 | 1/1946 | Lum | 417/269 |
| 2,881,973 | 4/1959 | Ricardo | 92/71 |
| 2,915,014 | 12/1959 | Morris | 92/12.2 |
| 2,997,956 | 8/1961 | Stewart | 74/60 |
| 3,160,110 | 12/1964 | Budzich | 74/60 |
| 4,283,962 | 8/1981 | Forster | 417/222 |
| 4,475,871 | 10/1984 | Roberts . | |
| 4,896,506 | 1/1990 | Shivvers et al. | 92/12.2 |
| 4,934,157 | 6/1990 | Suzuki et al. . | |
| 4,960,366 | 10/1990 | Higuchi | 417/269 |

FOREIGN PATENT DOCUMENTS

| | | | |
|---|---|---|---|
| 2048164 | 12/1971 | Fed. Rep. of Germany | 91/506 |
| 1223681 | 5/1961 | France | 417/269 |
| 61-171886 | 8/1986 | Japan . | |
| 62-55478 | 3/1987 | Japan . | |
| 1-83185 | 6/1989 | Japan . | |
| 227848 | 11/1969 | U.S.S.R. | 417/269 |
| 561893 | 11/1972 | United Kingdom | 417/269 |

*Primary Examiner*—Edward K. Look
*Assistant Examiner*—Thomas E. Denion
*Attorney, Agent, or Firm*—Brooks Haidt Haffner & Delahunty

[57] ABSTRACT

A variable capacity wobble plate type compressor provided with a reciprocatory piston mechanism for compressing a refrigerant gas and discharging the compressed refrigerant gas, a drive shaft driven by an external drive source to allow an assembly of angularly variable drive and wobble plates to reciprocate the reciprocatory piston mechanism, a coil spring mounted on the drive shaft for applying a biasing force to the assembly of drive and wobble plates toward a predetermined angularly inclined position, and annular spring support members for supporting the opposite ends of the coil spring so that the coil spring is not in contact with the outer surface of the drive shaft, to thereby prevent an abrasion of the coil spring and the drive shaft when the coil spring is contracted and expanded during the operation of the compressor.

4 Claims, 3 Drawing Sheets

VARIABLE CAPACITY WOBBLE PLATE COMPRESSOR WITH ABRASION AVOIDABLE MOUNTING STRUCTURE FOR WOBBLE PLATE PRESSING SPRING

BACKGROUND OF THE INVENTION

1. Field of the Invention

The present invention relates to an improved internal construction of a variable capacity wobble plate type refrigerant compressor, and more particularly, to an improved structure for mounting, on a compressor drive shaft, a coil spring or springs which constantly apply a biasing force to a wobble plate, an inclination of which is changed with respect to a plane vertical to the axis of the drive shaft, to thus vary the stroke of pistons of the compressor and thereby change the compressor capacity 2. Description of the Related Art Japanese Unexamined ( Kokai ) Patent publication No. 62 - 55478 published on Mar. 11, 1987 and Japanese Unexamined ( Kokai ) Utility Model publication No. 1 - 83185 automatically published on June 2, 1989, by the Japanese Patent Office, disclose a variable capacity wobble plate type refrigerant compressor provided with a rotatable drive shaft, a reciprocating piston type compressing mechanism to pump in a refrigerant before compression, compress the refrigerant, and discharge the refrigerant after compression, and an assembly of drive and wobble plates mounted around the drive shaft, an inclination of which can be changed with respect to a plane vertical to the axis of the drive shaft to change the stroke of the reciprocation of the pistons and thereby vary a discharge capacity of the compressor. The variable capacity wobble plate type refrigerant compressor is further provided with a coil spring mounted around the drive shaft, to constantly apply a biasing force to the assembly of the drive and wobble plates toward a small inclination angle position and thereby shift the assembly to a predetermined position corresponding to the smallest capacity position when the compressor is stopped. Due to the provision of the above-mentioned coil spring, when the variable capacity compressor is accommodated in a car air-conditioner, starting of the compressor driven by a car engine via a rotation transmission mechanism can be prevented under a condition such that the reciprocating piston type compressing mechanism exhibits the maximum reciprocation stroke thereof, and accordingly, a mechanical shock which usually occurs at the start of operation of the compressor can be limited to a smallest possible extent. Also, when the assembly of the drive and wobble plates is urged by the coil spring toward a small inclination angle position thereof, a compression of the liquid phase refrigerant does not occur even if the liquid phase refrigerant is pumped into the compressor from the external circuit of the air-conditioner at the moment of starting of the compressor, and therefore, damage to or a breaking of the internal components of the compressor due to the compressing of the liquid phase refrigerant does not occur.

U.S Pat. No. 4,934,157 to I. Takanashi et al which is assigned to the same assignee as for the present application, discloses a variable capacity wobble plate type compressor in which a pressure within a crankcase chamber for accommodating therein an assembly of drive and wobble plates is adjusted by controlling the duty ratio of a solenoid-operated pressure control valve, to adjustably change an angle of inclination of the drive and wobble plate assembly with respect to a plane vertical to the axis of a compressor drive shaft.

The compressor of U.S. Pat. No. 4,934,157 employs a spring element mounted around the compressor drive shaft for constantly urging the drive and wobble plate assembly from a small inclination angle position corresponding to a small discharge capacity position toward a larger inclination angle position corresponding to a large discharge capacity position, to thereby obtain a quick change of the drive and wobble plate assembly from the small discharge capacity position toward the large discharge capacity position.

FIG. 4 illustrates a further example of a conventional variable capacity refrigerant compressor corresponding to a compressor disclosed in Japanese Unexamined ( Kokai ) Patent publication No. 61 - 171886 published on Aug. 2, 1986, by the Japanese Patent Office. The compressor shown in FIG. 4 has a swash plate 42 arranged within a crankcase chamber 41 and tiltably supported on a ball-shaped slider 44, which is slidable on a drive shaft 43. The swash plate 42 is engaged, via a hinge mechanism 46, with a rotating element 45 rotatable with the drive shaft 43, and further engaged, via a pair of ball-shaped shoes 48, with each of a plurality of reciprocatory pistons 47. Therefore, the rotation of the swash plate 42 causes the reciprocation of the pistons 47 within a cylinder bore to compress a refrigerant gas in the cylinder bores. The compressor of FIG. 4 is provided with a coil spring 49 arranged between the slider 44 and the rotating element 45 to constantly urge the swash plate 42 toward a small discharge capacity position thereof.

Nevertheless, in the above-described conventional variable capacity refrigerant compressors, the spring element, particularly the coil spring, is usually coiled around the drive shaft of the compressor and is in contact with the cylindrical surface of the drive shaft, and accordingly, when the coil spring is frequently subjected to contraction and expansion in response to a change in an inclination angle of the drive and wobble plate assembly, the coil spring and the surface of the drive shaft are gradually abraded. Further, during the operation of the compressor with a constant inclination angle of the assembly of drive and swash plates, the coil spring is vibrated at an intermediate portion thereof by either sensing or resonating with a vibration due to the compressing and discharging motion of the compressor. Accordingly, the intermediate portion of the coil spring in contact with the surface of the drive shaft is gradually abraded during the vibration thereof, and the surface of the drive shaft of the compressor is also abraded. The abrasion of the coil spring causes a degradation of the elasticity and a shortening of the life of the coil spring, and consequently, the performance of the compressor per se is gradually degraded over a long term use thereof.

SUMMARY OF THE INVENTION

Therefore, an object of the present invention is to obviate the above-mentioned problem encountered by the conventional variable capacity refrigerant compressor provided with an inclination angle changeable swash plate or a swash and wobble plate assembly and a coil spring for applying a biasing force to the swash plate or the swash and wobble plate assembly.

Another object of the present invention is to provide a variable capacity wobble plate type refrigerant compressor having an improved internal construction capable of preventing an abrasion of a coil spring element mounted around a drive shaft of the compressor.

A further object of the present invention is to provide a simple but accurate means for positioning a coil spring on a drive shaft of a variable capacity wobble plate type compressor without coming into contact with the surface of the drive shaft.

In accordance with the present invention, there is provided a variable capacity wobble plate type refrigerant compressor including a rotatably supported axial drive shaft driven by an external drive source, a plurality of pistons reciprocating in cylinder bores to compress a refrigerant gas and discharge a compressed refrigerant gas, an assembly of drive and wobble plates slidably mounted on the drive shaft via a slide member, and engaged with the plurality of pistons via connecting rods, the assembly of drive and wobble plates being provided for converting a rotation of the drive shaft into a reciprocation of each of the plurality of pistons, and capable of changing an angle of inclination thereof from a plane vertical to the axis of the drive shaft, to change a stroke of each of the pistons and thereby vary a compressor capacity, and at least one coil spring mounted around the drive shaft for applying a biasing force to the assembly of drive and wobble plates to thereby constantly urge the assembly toward a predetermined angular position of inclination, the compressor comprising: a unit for supporting opposite ends of the coil spring so that they are not in contact with an outer surface of the drive shaft during a contracting and expanding movement of the coil spring on the drive shaft, when the assembly of drive and wobble plates is slid on the drive shaft to change the angle of inclination thereof.

In a variable capacity wobble plate type refrigerant compressor according to the present invention, the coil spring arranged for applying a constant biasing force to the drive and wobble plate assembly is mounted on the drive shaft and is not in contact with the surface of the drive shaft at the axially intermediate portion thereof, and therefore, during the operation of the compressor, the coil spring contracting and expanding in response to a change in an angle of inclination of the wobble plate is not subjected to abrasion. In addition, since the coil spring has an inner diameter such that is is never in contact with the outer surface of the drive shaft, due to the provision of a spacing between the intermediate portion of the coil spring and the outer surface of the drive shaft, although a vibration due to the compressing and discharging motion of the internal working components of the compressor causes a vibration of the intermediate portion of the coil spring, an abrasion of the intermediate portion of the coil spring does not occur.

DESCRIPTION OF THE DRAWING

The above and other objects, features, and advantages of the present invention will be more readily understood from the ensuing description of the embodiments with reference to the accompanying drawings wherein.

DESCRIPTION OF THE PREFERRED EMBODIMENTS

Figure 1:
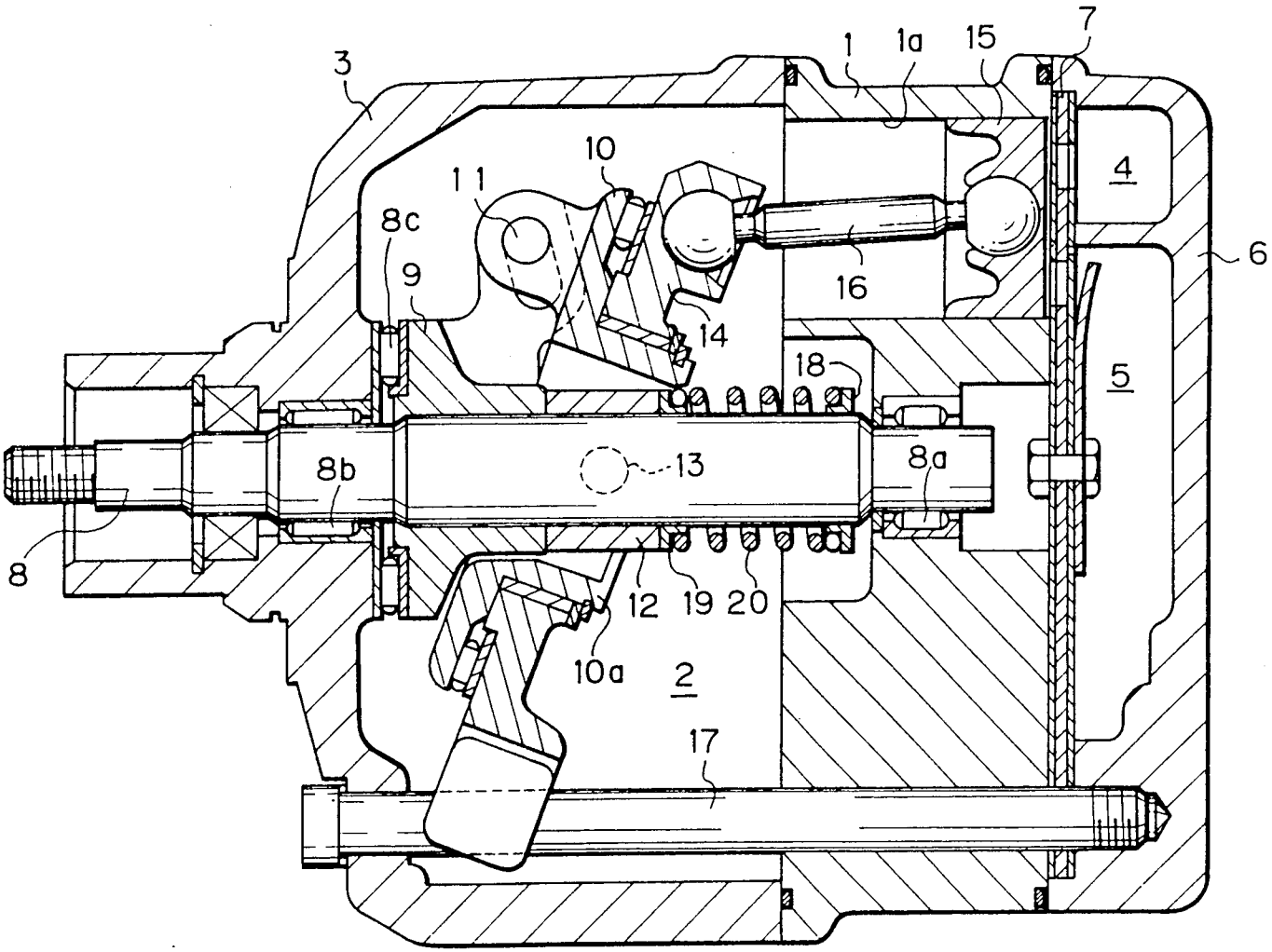
FIG. 1 is a longitudinal cross-sectional view of a variable capacity wobble plate type refrigerant compressor embodying the present invention.

Referring to FIG. 1, a variable capacity wobble type compressor is provided with a cylinder block 1 having a plurality of cylinder bores 1*a*, a front housing 3 combined with a front end of the cylinder block 1 to define therein a crank chamber 2 which is in communication with the cylinder bores 1*a*, and a rear housing 6 combined with a rear end of the cylinder block 1 via a valve plate 7 to define therein a suction chamber 4 for a refrigerant before compression and a discharge chamber 5 for a refrigerant after compression. A drive shaft 8 is rotatably supported by the cylinder block 1 and the front housing 3 via radial bearings 8*a* and 8*b*. The drive shaft 8 is provided with a rotating member 9 rigidly mounted thereon to be rotated together therewith. The rotating member 9 has a lug to which a rotatable drive plate 10 having a cylindrical boss 10*a* is movably connected via a connecting pin 11, to be rotatable together with the member 9 about the axis of the drive shaft 8 and to be capable of pivoting about the pin 11 while changing an inclination thereof with respect to a plane vertical to the axis of the drive shaft 8. A slide element 12 is axially slidably mounted on the drive shaft 8, and has a pair of radially projected pins 13 arranged at diametrically opposite positions of the slide element 12. The cylindrical boss 10*a* of the rotatable drive plate 10 is pivotally supported on the pins 13, and therefore, the drive plate 10 is pivotable about the pins 13.

A wobble plate 14 is mounted on the cylindrical boss 10*a* of the drive plate 10 via a thrust bearing 8*c*. Thus, when the drive plate 10 is rotated together with the drive shaft, the wobble plate 14 carries out a wobbling motion about the axis of the drive shaft 8. Namely, the thrust bearing 8*c* prevents the rotation of the drive plate 10 from being transmitted to the wobble plate 14 but permits the rotation of the drive plate 10 to cause the wobbling motion of the wobble plate 14. When an angle of inclination of the drive plate 10 is changed, the wobble plate 14 is also inclined together with the drive plate 10. Since a guide pin 17 is fixed to the front housing 3 and the rear housing 6 and is axially extended through a lower part of the wobble plate 14, the wobble plate 14 is not permitted to rotate about the axis of the drive shaft 8, due to the existence of the guide pin 17, and is axially guided by the guide pin 17 during the movement of the wobble plate 14 to change an angle of inclination thereof. The wobble plate 14 is connected to pistons 15, which are slidably fitted in the cylinder bores 1*a* of the cylinder block 1 via connecting rods 16, and therefore, the wobbling motion of the wobble plate 14 due to the rotation of the drive shaft 8 and the drive plate 10 causes a reciprocating motion of each piston 15 in the corresponding cylinder bore 1*a*, to thereby suck the refrigerant before compression from the suction chamber 4, compress the refrigerant, and discharge the refrigerant after compression from the cylinder bores 1*a* toward the discharge chamber 5.

The drive shaft 8 of the compressor is provided with a annular member 18 fixedly mounted on a rear end portion of the shaft 8 at a preselected position. The cylindrical member 18 as formed in a flanged member is cooperable with a different annular flanged member 19 slidably fitted on the drive shaft 8 at a position axially spaced from the annular member 18 and adjacent to the slide element 12, for supporting opposite ends of a coil spring 20. The coil spring 20 thus supported by the fixed and slidable support member 18 and 19 constantly applies a biasing force to the assembly of the drive and wobble plates 10 and 14 via the slide member 12, to thereby urge the assembly toward a position whereat an angle of inclination of the assembly of drive and wobble plates 10 and 14 is increased. It should be noted that both ends of the coil spring 20 are fitted around the cylindrical outer surfaces of the annular support members 18 and 19 to be held against and supported by the flanges of the annular support members 18 and 19. Therefore, the coil spring 20 is arranged in such a manner that no part of the coil spring 20 is maintained in contact with the outer surface of the drive shaft 8, due to the existence of the annular support members 18 and 19.

Although not illustrated in FIG. 1, a control valve for regulating a pressure in the crank chamber 2, which is similar to the control valve disclosed in U.S. Pat. No. 4,934,157 is provided in the rear housing 6.

The operation of the compressor of the embodiment of FIG. 1 will be described below.

When the variable capacity wobble plate type refrigerant compressor is driven by an external drive source, i.e., a car engine and an appropriate motion transmission mechanism, the drive shaft 8 and the drive plate 10 are rotated together. The rotation of the drive plate 10 inclined from a plane vertical to the axis of the drive shaft 8 causes a wobbling motion of the wobble plate 14 mounted thereon, to thereby reciprocate the pistons 15 within respective cylinder bores 1*a*, and thus the suction of the refrigerant gas into the cylinder bores 1*a*, the compression of the sucked refrigerant gas, and the discharge of the compressed refrigerant gas are carried out. During the above-mentioned refrigerant gas compressing operation of the compressor, the pressure prevailing in the crank chamber 2 is regulated by the control valve in such a manner that the angle of inclination of the assembly of the drive and wobble plates 10 and 14 is changed in response to a change in a pressure differential between pressures in the crank and suction chambers 2 and 4, and therefore, the stroke of the pistons 15, and accordingly the compressor capacity, are varied. When the angle of inclination of the assembly of the drive and wobble plates 10 and 14 is changed, the slide member 12 and the slidable annular member 19 are slid together on the drive shaft 8, to cause a contraction and an expansion of the coil spring 20 from the initial position thereof set during the assembling of the compressor. Nevertheless, as described before, the coil spring 20, especially the inner side thereof, is kept out of contact with the outer surface of the drive shaft 8 by the existence of the fixed and slidable annular members 18 and 19, and accordingly, the coil spring 20 is not subjected to an unfavourable abrasion during the contraction and the expansion thereof.

Further, while the operation of the compressor is carried out with the assembly of the drive and wobble plates 10 and 14 kept at a constant angle of inclination thereof, even if a vibrating motion contained in the compressing and discharging motions of the compressor is transmitted to the coil spring 20 to cause a vibrating of the coil spring 20 at the intermediate portion thereof, the coil spring 20 is not abraded, due to a spacing provided between the inner side of the coil spring 20 and the outer surface of the drive shaft 8.

At this stage, it should be noted that, during the contraction and expansion of the coil spring 20, although the slidable annular member 19 is slid on the drive shaft 8 while maintaining a mechanical contact thereof with the outer surface of the drive shaft 8, such a mechanical contact is obviously a surface contact and not a line contact encountered by the coil spring of the conventional variable capacity compressor. Therefore, a contact pressure denoted by, e.g., a dimension of ( kg / $cm^2$ ), between the slidable annular member 19 and the outer surface of the drive shaft 8 is small, and accordingly, a friction between the annular member 19 and the drive shaft 8 is small compared with that between the coil spring and the drive shaft of the conventional compressor. Consequently, an unfavourable abrasion of the slidable annular member 19 and the drive shaft 8 does not occur. Further, both ends of the coil spring 20 are secured to the fixed and slidable annular members 18 and 19, and therefore, the contracting and the expanding motions of the coil spring 20 do not cause a friction between the coil spring 20 and the members 18 and 19. Therefore, the ends of the coil spring 20 and the surface of the annular members 18 and 19 are not subjected to abrasion.

The metallic material of which the coil spring 20 is made must be limited to a predesigned material, from the view point of a required elastic characteristic of a spring element to be incorporated in the compressor, and accordingly, the material of the coil spring 20 cannot be changed. Nevertheless, a metallic material of which the slidable annular member 19 is made should be selected from low frictional metallic materials such as bearing metals, to maintain a low friction between the annular member 19 supporting the coil spring 20 and the outer surface of the drive shaft 8.

Figure 2:
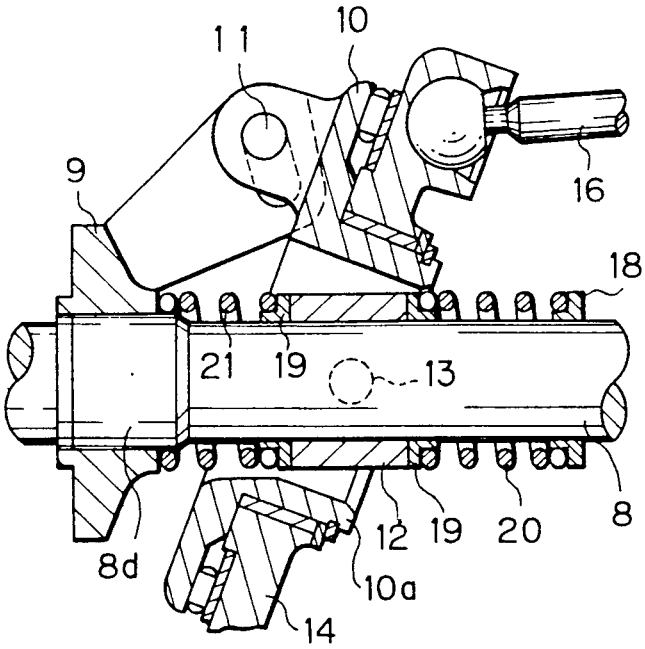
FIG. 2 is a partial cross-sectional view of a part of a variable capacity wobble plate type refrigerant compressor according to another embodiment of the present invention.

FIG. 2 illustrates a second embodiment of the present invention. The compressor of FIG. 2 is different from that of FIG. 1 in that an additional coil spring 21 is arranged between the end of the drive plate 9 and the slide member 12. The arrangement of the coil spring 20 is identical with that of the embodiment of FIG. 1. The coil spring 21, i.e., the front coil spring, has a front end thereof supported on a large diameter portion 8*d* of the drive shaft 8, and a rear end thereof fixedly supported on a slidable annular member 19' arranged adjacent to a front end of the slide member 12, and thus the additional coil spring 21 is not in contact with the outer surface of the drive shaft 8. Namely, both coil springs 20 and 21 having inner diameters thereof larger than the outer diameter of the drive shaft 8 are stably supported by the annular members 18, 19, 19' and the larger diameter portion 8*d* of the drive shaft 8, to maintain a constant spacing between the inner side of respective coil springs 20 and 21 and the outer surface of the drive shaft 8. Accordingly, during the operation of the compressor, neither an abrasion of the coil springs 20 and 21 nor a frictional wear of the drive shaft 8 occurs, and thus the elastic characteristics of the coil springs 20 and 21 are not changed over a long operational life of the compressor, and the durability of the coil springs 20 and 21 is ensured.

Figure 3:
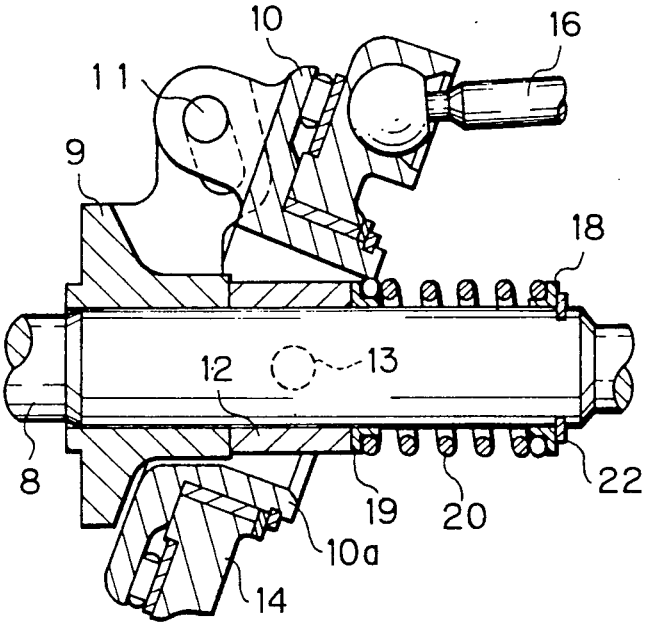
FIG. 3 is a partial cross-sectional view of a part of a variable capacity wobble plate type refrigerant compressor according to a further embodiment of the present invention; and, FIG. 4 is a longitudinal cross-sectional view of a variable capacity wobble plate type refrigerant compressor according to a prior art.
Figure 4:
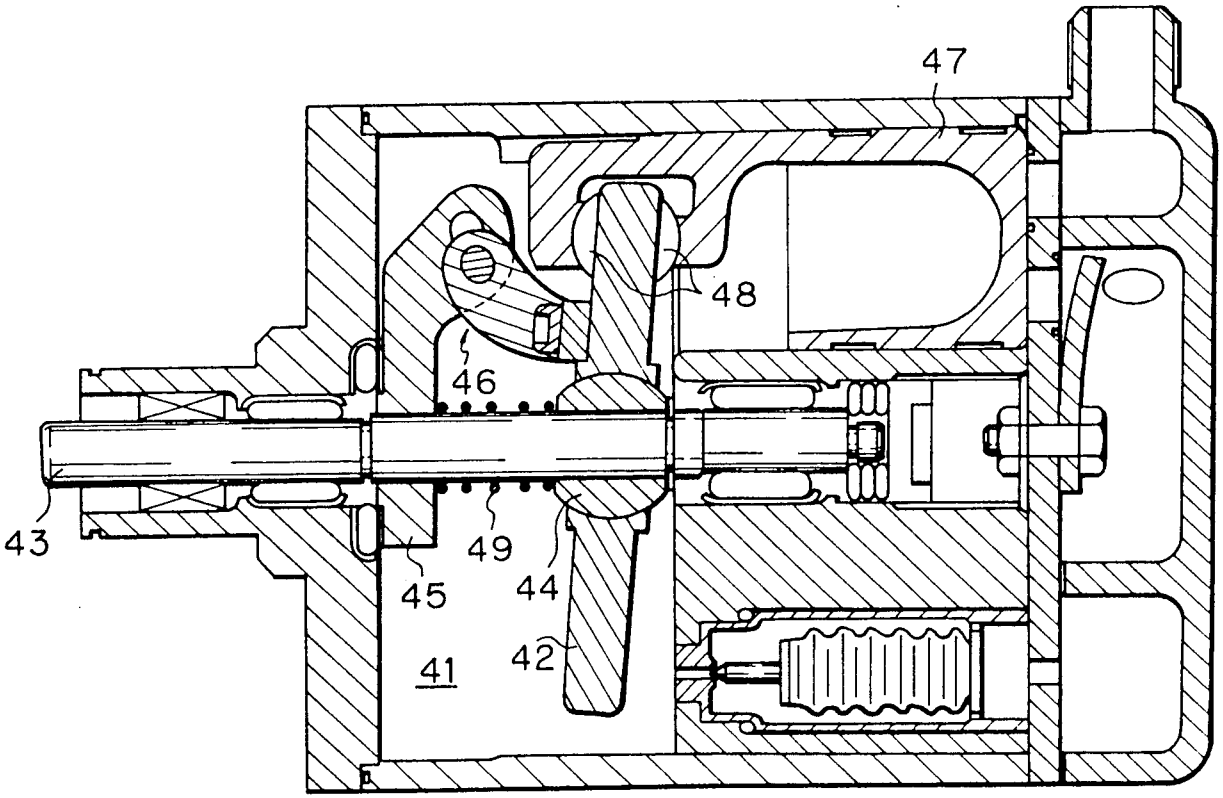
Fig. 4 PRIOR ART

FIG. 3 illustrates a further embodiment of the present invention in which a snap ring 22 is arranged at a rear end portion of the drive shaft 8 so that, when the annular member 18 is mounted on the drive shaft 8 to be slidable therealong, the sliding movement of the member 18 away from the assembly of the drive and wobble plates 10 and 14 beyond a limited position is stopped by the snap ring 22.

Although not illustrated in the accompanying drawings, the present invention is applicable to variable capacity type refrigerant compressors other than the illustrated wobble plate type compressor.

From the foregoing, it will be understood that, in the variable capacity wobble plate type compressor, a coil spring for applying a predetermined biasing force to the assembly of the drive and wobble plates can be prevented from being abraded by friction, due to the existence of annular support members supporting the ends of the coil spring or springs. Also, an abrasion of the drive shaft can be lessened. Therefore, the durability of the coil spring and the drive shaft can be enhanced, and accordingly the operation of the variable capacity wobble plate type compressor is more reliable than of a similar conventional compressor.

We claim:

1. A variable capacity wobble plate type refrigerant compressor including a rotatably supported axial drive shaft driven by an external drive source, a plurality of pistons reciprocating in cylinder bores to compress a refrigerant gas and discharge compressed refrigerant gas, an assembly of drive and wobble plates slidably mounted on the drive shaft via a slide member, and engaged with the plurality of pistons via connecting rods, the assembly of drive and wobble plates being provided for converting a rotation of the drive shaft into a reciprocation of each of the plurality of pistons, and capable of changing an angle of inclination thereof from a plane vertical to the axis of the drive shaft to change the stroke of each of the pistons to thereby vary the compressor capacity, and at least one coil spring mounted around the drive shaft for applying a biasing force to the assembly of drive and wobble plates to thereby constantly urge the assembly toward a predetermined angular position of inclination, the compressor comprising:

annular flanged support means for supporting opposite ends of the coil spring so that the coil spring does not come into contact with an outer surface of the drive shaft during a contracting and expanding movement of the coil spring on the drive shaft when the assembly of drive and wobble plates is slid on the drive shaft to change the angle of inclination thereof, said coil spring supporting means comprising a first annular flanged member slidably mounted on the drive shaft for fixedly supporting one of the opposite ends of the coil spring, a second annular flanged member slidably mounted on the drive shaft at a position adjacent to the slide member which permits the assembly of drive and wobble plates to slide on the drive shaft, said second annular flanged member being arranged to be axially spaced from the first annular flanged member for fixedly supporting the other opposite end of the coil spring, and a snap ring member fixedly mounted on the drive shaft at a predetermined position on one end portion of said drive shaft for stopping sliding movement of said first annular flanged member beyond said predetermined position on the drive shaft.

2. A variable capacity wobble plate type refrigerant compressor according to claim 1, wherein said coil spring supported by said first and second annular flanged members has an axially intermediate portion thereof having an inner diameter thereof larger than an outer diameter of said drive shaft.

3. A variable capacity wobble plate type refrigerant compressor according to claim 1, wherein said second annular member is made of a low friction metallic material.

4. A variable capacity wobble plate type refrigerant compressor according to claim 1, wherein said first and second annular members of a low friction metallic material.

* * * * *

UNITED STATES PATENT AND TRADEMARK OFFICE

CERTIFICATE OF CORRECTION

PATENT NO. : 5,056,416

DATED : October 15, 1991

INVENTOR(S) : M. Ota et al

It is certified that error appears in the above-identified patent and that said Letters Patent is hereby corrected as shown below:

Col. 8, line 13, after "shaft" insert --at a position adjacent to one end portion of the drive shaft--.

Col. 8, line 40, after "members" insert --are made--.

Signed and Sealed this

Thirteenth Day of April, 1993

*Attest:*

STEPHEN G. KUNIN

*Attesting Officer*

*Acting Commissioner of Patents and Trademarks*